US010563492B2

(12) United States Patent
Stokholm et al.

(10) Patent No.: US 10,563,492 B2
(45) Date of Patent: Feb. 18, 2020

(54) METHOD FOR ELECTRICALLY ENHANCED OIL RECOVERY

(71) Applicant: EOR Technologies ApS, Virum (DK)

(72) Inventors: Bjørn Stokholm, Odense SV (DK); Frank Hanisch, Emmetten (CH)

(73) Assignee: EOR Technologies ApS, Virum (DK)

( * ) Notice: Subject to any disclaimer, the term of this patent is extended or adjusted under 35 U.S.C. 154(b) by 156 days.

(21) Appl. No.: 15/513,733

(22) PCT Filed: Sep. 23, 2015

(86) PCT No.: PCT/DK2015/050289

§ 371 (c)(1),
(2) Date: Mar. 23, 2017

(87) PCT Pub. No.: WO2016/045682

PCT Pub. Date: Mar. 31, 2016

(65) Prior Publication Data

US 2018/0230787 A1 Aug. 16, 2018

(30) Foreign Application Priority Data

Sep. 23, 2014 (DK) ..... 2014 00543

(51) Int. Cl.
*E21B 43/16* (2006.01)
*E21B 43/25* (2006.01)
*E21B 43/38* (2006.01)

(52) U.S. Cl.
CPC ..... *E21B 43/16* (2013.01); *E21B 43/25* (2013.01); *E21B 43/38* (2013.01)

(58) Field of Classification Search
CPC ..... E21B 43/2401; E21B 43/16
See application file for complete search history.

(56) References Cited

U.S. PATENT DOCUMENTS 4,084,638 A * 4/1978 Whiting ..... E21B 43/003 166/248
4,199,025 A 4/1980 Carpenter
(Continued)

FOREIGN PATENT DOCUMENTS

EP 2623709 A1 2/2012
WO 03/038230 A2 5/2003
(Continued)

OTHER PUBLICATIONS

European Search Report dated Apr. 30, 2018 in corresponding European application No. 15844855.5.
(Continued)

*Primary Examiner* — Catherine Loikith
(74) *Attorney, Agent, or Firm* — Gearhart Law, LLC

(57) ABSTRACT

A method of electrically enhancing oil-recovery from an underground rock formation comprising an oil-bearing reservoir is herein detailed. According to the method a controlled electrical charging potential between two or more electrically conductive elements is imposed for a charging time sufficient to cause a capacitive charging of the rock formation, the charging being followed by lowering or maintaining the charging potential below 40 mV per running meter between the conductive elements; during oil withdrawal. Further, a capacitor charging pump having feedback means for use with the method is detailed.

17 Claims, 2 Drawing Sheets

(56) References Cited

U.S. PATENT DOCUMENTS

| | | | | |
|---|---|---|---|---|
| 7,325,604 | B2 | 2/2008 | Wittle et al. | |
| 2005/0199387 | A1 | 9/2005 | Wittle et al. | |
| 2012/0152570 | A1* | 6/2012 | Thomas | E21B 43/16 166/400 |
| 2012/0273190 | A1 | 11/2012 | Thomas et al. | |
| 2013/0112401 | A1* | 5/2013 | Guerrero | E21B 41/0085 166/244.1 |
| 2013/0277046 | A1* | 10/2013 | Haroun | E21B 43/16 166/248 |
| 2013/0312957 | A1 | 11/2013 | Grimes | |

FOREIGN PATENT DOCUMENTS

| | | | |
|---|---|---|---|
| WO | 2007/084763 | A2 | 7/2007 |
| WO | 2008/030337 | A2 | 3/2008 |
| WO | 2010/047612 | A1 | 4/2010 |

OTHER PUBLICATIONS

International Search Report and Written Opinion dated Apr. 12, 2015 during prosecution of International Application No. PCT/DK2015/050289.

* cited by examiner

METHOD FOR ELECTRICALLY ENHANCED OIL RECOVERY

CROSS REFERENCE TO RELATED APPLICATION

This application is a national application of PCT-application PCT/DK2015/050289 filed on Sep. 23, 2015, which claims priority of Danish patent application No. PA201400543 filed on 23 Sep. 2014, both of which disclosures are incorporated herein by reference.

FIELD

The present invention relates to the use of direct (DC) or alternating current (AC) to enhance oil production from oil reservoirs in rock formations, in particular from carbonate rock formations, in oil-sand or in oil-shale.

BACKGROUND

The world resources of oil exist in a number of geological formations with more than 40% of the reservoirs formed in carbonates e.g. limestone ($CaCO_3$) or dolomite $CaMg(CO_3)_2$. From these formations oil is recovered by drilling and pumping. Also oil-sand and oil-shale reservoirs account for a significant portion of the world's combined oil-resources.

The oil in rock formations in general is present in pores and cavities of the rock, sand or shale. The accessibility to the oil in an oil field is largely determined by the porosity of the reservoir formation and the permeability of the oil, both factors which can vary a lot depending on location and whether the reservoir drilled contains a significant number of cracks and fractures at the drill location. Typically such oil-bearing formations are found beneath the upper strata of the earth, referred to generally as the overburden, at depths of 300 meters or more, whereas oil in sand and shale can be found already at depths of 20 meters and below.

Inside such oil bearing rock formations, the oil is detained within the pores primarily by capillary forces, e.g. by wetting the rock surfaces, and electrostatic forces. E.g. in carbonate rock some oils are oxidized to carboxylic acids which further enhances the electrostatically binding to the positively charged carbonate rock. Often, however, the rock surfaces are also wetted by water, which leads to complicated water-oil interactions inside the rock formation.

In oil recovery a pressure must be added which is sufficient to exceed the electrostatic and the capillary binding forces of the oil to the rock in order to achieve an oil flow. During production, oil will be recovered from the larger pores first, which are then filled with injection water, which are injected into the drill hole at pressures of several hundred bar in order to effect an oil migration. This leads to an increased water/oil ratio during recovery.

If the capillary forces or the electrostatic forces binding the oil can be reduced, it has long been recognized that a higher recovery can be obtained. Various methods of altering the wetting properties of oil on carbonate surfaces have been suggested and implemented in the prior art, in particular injection of surfactants and negatively charged counter-ions to disrupt wetting and electrostatic association of oil and rock. Also viscosity reducing methods, notably heat, have been systematically used in oil production.

Electrically enhanced oil production (EEOP) is a proven quaternary oil recovery (QOR) technology and has been shown to be economically viable at recovery costs below other methods of recovery, such as e.g. secondary and tertiary oil recovery technologies.

Most methods of electrically enhanced oil-production (EEOP) involve passing direct current (DC) between cathodes in producing well completion intervals and anodes either at the surface and/or at depth in other wells. The electrokinetic mechanisms indicated to be operative based on the available data of the prior art are 1) joule heating, 2) electro-chemical reactions and 3) electro-osmotic flow (EOF). In general, however, the physico-chemical processes observed during EEOP are co-existing and all contribute to the beneficial results on oil recovery from the method. It has been established in many field test that EEOP as a quaternary oil recovery (QOR) technique is superimposable on existing secondary and tertiary recovery techniques without limitations.

A representative method for enhanced oil recovery from carbonate reservoirs is described in US 2013/0277046 A1, the contents of which is hereby incorporated by reference; the method comprising the steps of selecting an underground formation comprising an oil-bearing carbonate reservoir, positioning two or more electrically conductive elements at spaced apart locations in proximity to said formation, at least one of said conductive elements being disposed in or adjacent to a borehole affording fluid communication between the interior of said borehole and said formation, passing a controlled amount of electric current along an electrically conductive path through said formation, said electric current being produced by a DC source including a cathode connected to another of said conductive elements, said electrically conductive path comprising at least one of connate formation water and an aqueous electrolyte introduced into said formation, and withdrawing oil from at least one of said boreholes.

A drawback of the currently known methods in the art is a requirement of high electrical potentials between the electrodes of the EEOP, preferably not less than 0.4 V per running meter between electrodes, resulting in increased energy consumption during oil recovery. Also the methods of the prior art have failed to be efficient in viscous or heavy oil reserves.

Surprisingly, the present inventors have now discovered that the energy requirement can be significantly lowered compared to conventional methods of EEOP by following the methods as described in the present invention, while at the same time reducing oil-viscosity and allowing oil recovery from hard oil reserves.

SUMMARY OF THE INVENTION

The invention relates in a first aspect to a method of electrically enhancing oil-recovery from an underground oil-bearing reservoir (3), comprising: (a) selecting an underground rock formation (2) comprising an oil-bearing reservoir (3); (b) positioning two or more electrically conductive elements (4,5) at two or more spaced apart locations in proximity to said formation (2,3), at least one of said conductive elements (4,5) being disposed in or adjacent to a borehole affording fluid communication between the interior of said borehole and said formation; (c) imposing a controlled electrical charging potential between said two or more electrically conductive elements (4,5) for a charging time sufficient to cause a capacitive charging of said formation to an operating charging potential; (d) lowering or maintaining said charging potential below 40 mV per running meter between said two or more electrically conductive elements (4,5); and (e) withdrawing oil from at least one of said boreholes.

In a second aspect the invention relates to a method of electrically enhancing oil recovery from an underground oil-bearing reservoir (3), comprising: (a) selecting an underground rock formation (2) comprising an oil-bearing reservoir (3); (b) positioning two or more electrically conductive elements (4,5) at two or more spaced apart locations in proximity to said formation (2,3), at least one of said conductive elements (4,5) being disposed in or adjacent to a borehole affording fluid communication between the interior of said borehole and said formation; (c) passing a controlled amount of electric current along an electrically conductive path through said formation, said electric current being produced by a DC source capacitor charging pump (1); (d) causing a capacitive charging of said formation at a charging potential; (e) lowering or maintaining said charging potential below 40 mV per running meter between said two or more electrically conductive elements (4,5); and (f) withdrawing oil from at least one of said boreholes.

In an embodiment of the first and second aspect of the present invention there is disclosed a method of electrically enhancing oil recovery from an underground oil-bearing reservoir (3), wherein said method is a method of increasing an oil discharge pressure in a borehole in fluid connection with an underground oil-bearing reservoir (3).

The invention relates in a third aspect to a method of increasing an oil-gravity value (° API) of an oil-product obtained from an underground oil-bearing reservoir (3), comprising: (a) selecting an underground rock formation (2) comprising an oil-bearing reservoir (3); (b) positioning two or more electrically conductive elements (4,5) at two or more spaced apart locations in proximity to said formation (2,3), at least one of said conductive elements (4,5) being disposed in or adjacent to a borehole affording fluid communication between the interior of said borehole and said formation; (c) imposing a controlled electrical charging potential between said two or more electrically conductive elements (4,5) for a charging time sufficient to cause a capacitive charging of said formation to an operating charging potential; (d) lowering or maintaining said charging potential below 40 mV per running meter between said two or more electrically conductive elements (4,5); and (e) withdrawing oil from at least one of said boreholes.

The invention relates in a fourth aspect to a method of increasing an oil-gravity value (° API) of an oil-product obtained from an underground oil-bearing reservoir (3), comprising: (a) selecting an underground rock formation (2) comprising an oil-bearing reservoir (3); (b) positioning two or more electrically conductive elements (4,5) at two or more spaced apart locations in proximity to said formation (2,3), at least one of said conductive elements (4,5) being disposed in or adjacent to a borehole affording fluid communication between the interior of said borehole and said formation; (c) passing a controlled amount of electric current along an electrically conductive path through said formation, said electric current being produced by a DC source capacitor charging pump (1); (d) causing a capacitive charging of said formation at a charging potential; (e) lowering or maintaining said charging potential below 40 mV per running meter between said two or more electrically conductive elements (4,5); and (f) withdrawing oil from at least one of said boreholes.

In embodiments of the third and fourth aspects said methods of the invention are methods of converting heavy oil to light oil prior to withdrawing said oil from said oil-bearing reservoir (3). In further embodiments said methods are methods of reducing an oil-product viscosity prior to withdrawing said oil from said oil-bearing reservoir (3) and/or a method of permanently increasing an oil-gravity value (° API) of an oil-product obtained from an underground oil-bearing reservoir (3).

The invention relates in a fifth aspect to a method of reducing inorganic contents in an oil-product obtained from an underground oil-bearing reservoir (3), comprising: (a) selecting an underground rock formation (2) comprising an oil-bearing reservoir (3); (b) positioning two or more electrically conductive elements (4,5) at two or more spaced apart locations in proximity to said formation (2,3), at least one of said conductive elements (4,5) being disposed in or adjacent to a borehole affording fluid communication between the interior of said borehole and said formation; (c) imposing a controlled electrical charging potential between said two or more electrically conductive elements (4,5) for a charging time sufficient to cause a capacitive charging of said formation to an operating charging potential; (d) lowering or maintaining said charging potential below 40 mV per running meter between said two or more electrically conductive elements (4,5); and (e) withdrawing oil from at least one of said boreholes.

The invention relates in a sixth aspect to a method of reducing inorganic contents in an oil-product obtained from an underground oil-bearing reservoir (3), comprising: (a) selecting an underground rock formation (2) comprising an oil-bearing reservoir (3); (b) positioning two or more electrically conductive elements (4,5) at two or more spaced apart locations in proximity to said formation (2,3), at least one of said conductive elements (4,5) being disposed in or adjacent to a borehole affording fluid communication between the interior of said borehole and said formation; (c) passing a controlled amount of electric current along an electrically conductive path through said formation, said electric current being produced by a DC source capacitor charging pump (1); (d) causing a capacitive charging of said formation at a charging potential; (e) lowering or maintaining said charging potential below 40 mV per running meter between said two or more electrically conductive elements (4,5); and (f) withdrawing oil from at least one of said boreholes.

In an embodiment of the method according to any of the fifth and sixth aspects said method is a method of reducing the content of one or more of sulfur, nitrogen, phosphorus and/or water from an initial higher content in said oil-product to a resulting lower content in said oil-product.

In an embodiment according to any of said aspects and embodiments of the invention said underground rock formation (2) or said underground oil-bearing reservoir (3) is a carbonate reservoir, in particular limestone, a siliceous reservoir, in particular sandstone, oil sand, or oil shale.

In an embodiment according to any of said aspects and embodiments of the invention said capacitive charging is caused by a capacitor charging pump (1).

In an embodiment according to any of said aspects of the invention said the charging potential during oil-recovery is from 5 to 40 mV per running meter between said two or more spaced apart locations and/or the energy supplied is between 0.5 to 2.5 kWh.

In an embodiment according to any of said aspects and embodiments of the invention said two or more spaced apart locations are all boreholes and said two or more electrically conductive elements (4,5) are all located in and/or in close proximity to said underground oil-bearing reservoir (3).

In an embodiment according to any of said aspects and embodiments of the invention said two or more electrodes (4,5) are made from a corrosive resistant and highly conductive material, preferably copper, titanium, graphite, and/or stainless steel.

In an embodiment according to any of said aspects and embodiments of the invention said two or more electrodes (4,5) are arranged in anode-cathode pairs or in field arrays of anodes and cathodes wherein the electric fields of the anodes and cathodes are additive.

The invention relates in a sixth aspect to a capacitor charging pump (1) having feedback means for providing a capacitive charging of an underground oil-bearing reservoir (3); which capacitor charging pump (1) having feedback means is adapted to provide and maintain a charging current either in the form of a direct current (DC), a direct current overlaid with an AC current, or as an alternating current (AC), between two or more electrically conductive elements (4,5) positioned at two or more spaced apart locations in proximity to said reservoir (3), at least one of said conductive elements being disposed in or adjacent to a borehole affording fluid communication between the interior of said borehole and said reservoir (3).

In an embodiment said capacitor charging pump (1) further comprises a controller adapted for executing a method according to any of the aspects and embodiments disclosed herein.

DETAILED DESCRIPTION

As described in the prior art it is customary to apply an electrical potential between two or more electrically conductive elements positioned at two or more spaced apart locations in an oil-bearing underground rock formation in order to achieve electrically enhanced oil production. In the prior art, the electrical potential is kept constant at its initial value and is typically always in excess of 0.4 V per running meter between electrodes in the ground, see e.g. US 2013/0277046 A1 or U.S. Pat. No. 7,325,604 B2.

The present inventors have now surprisingly discovered that this common mode of operation is unnecessary and that the energy requirements of the process can be lowered by following the method of the present invention. To this end, the present inventors suggest a method of catalytic oil reforming, liquefaction and pressure boosting by electro capacitive soil (Corlpecs) reformation.

The present invention relies on the surprising realization by the present inventors that it is sufficient to achieve an initial capacitive charging of the underground rock formation between the electrodes to a level adequate for electrically enhanced oil production, after which charging electrically enhanced oil-recovery becomes possible, even if the electrical potential between electrodes is lowered at least a factor 10 compared to methods of the prior art, yet retaining the same oil-recovering benefits as known in the prior art. The inventors consider the observed effect potentially to be related to a steady-state replenishment of the energy consumed in the electrically enhanced oil-recovery process without considering themselves being bound by this theory.

Figure 1:
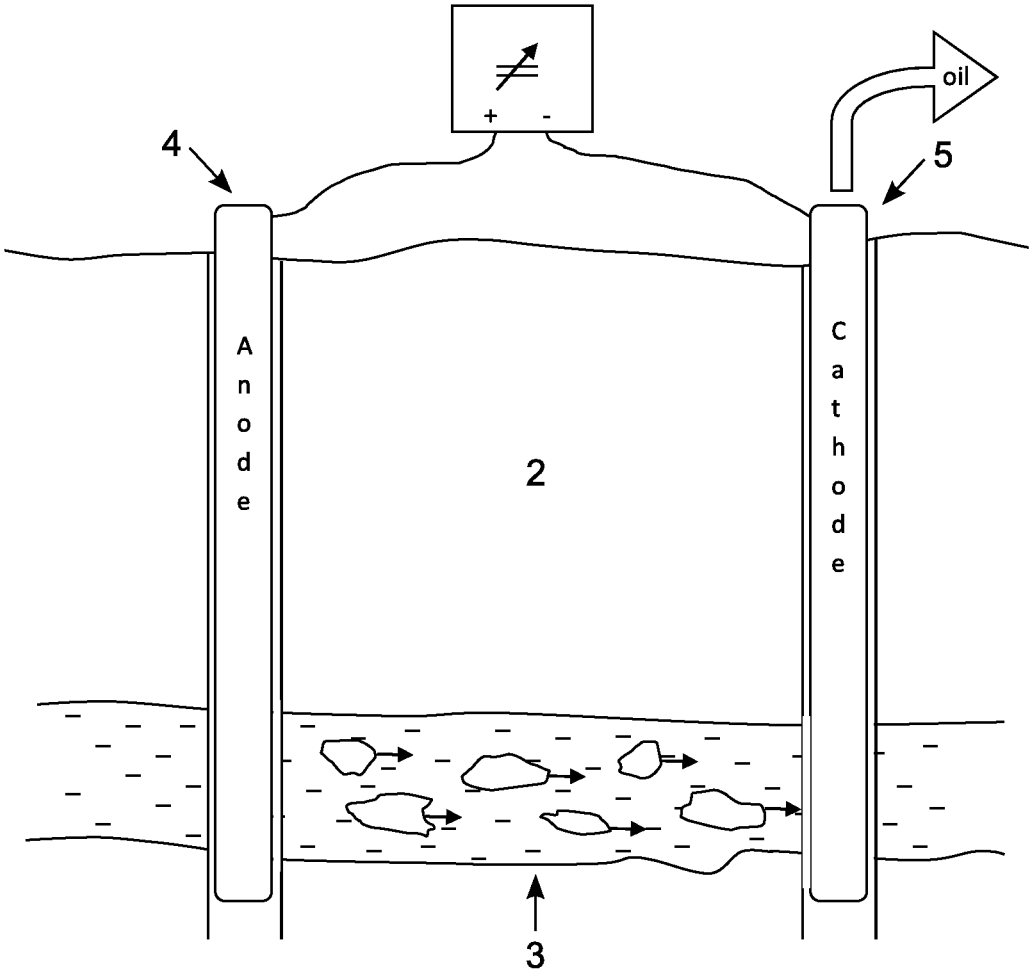
Prior Art Figure 1
FIG. 1: Schematic diagram of a DC electrokinetic method for EEOP of the prior art.

In FIG. 1 there is described an example of the setup of the electrically enhanced oil recovery system of the prior art. A rock formation (2) comprising an oil-bearing underground rock reservoir (3) into which two or more spaced apart boreholes have been drilled, one of which containing at least one conductive element, permitting the borehole to serve as an anode (4) and a further borehole also containing at least one conductive element, permitting this further borehole to serve as a cathode (5). In the setup shown in FIG. 1, the anode (4) and the cathode (5) are electrically connected via a DC source (6) capable of providing an electrical potential sufficient to generate a load current between anode (4) and cathode (5). When load currents of the prior art above 0.4 V per running meter between electrodes are chosen, oil is transported to the borehole comprising the cathode by electrokinetic forces, primarily by electro-osmosis.

Figure 2:
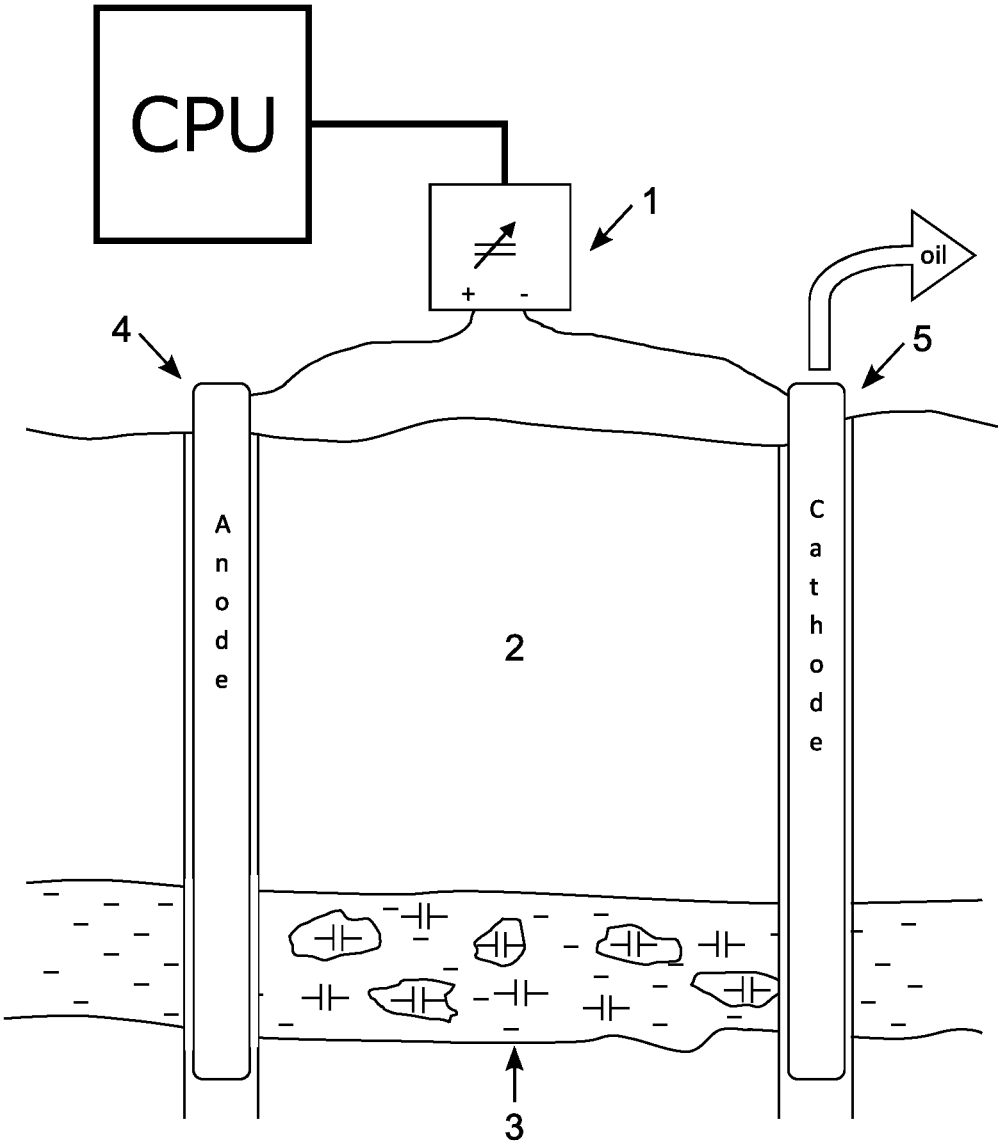
FIG. 2: Schematic diagram of a DC electro-capacitive method of EEOP according to the present invention.

In FIG. 2 there is described an example of the setup of the electrically enhanced oil recovery system of the present invention. A rock formation (2) comprising an oil-bearing underground rock reservoir (3) into which two or more spaced apart boreholes have been drilled, one of which containing at least one conductive element, permitting the borehole to serve as an anode (4) and a further borehole also containing at least one conductive element, permitting this further borehole to serve as a cathode (5). In the setup shown in FIG. 2, the anode (4) and the cathode (5) are electrically connected via a DC source capacitor charging pump (1) capable of providing an electrical potential sufficient to generate a load current between anode (4) and cathode (5). When load currents of the present invention are used oil is transported but following other transport mechanisms than primarily electro-osmosis. The DC source capacitor charging pump (1) of FIG. 2 could also be an AC source capacitor charging pump, or a DC source overlaid with an AC source capacitor charging pump.

Accordingly there is disclosed herein a method of electrically enhancing oil-recovery from an underground oil-bearing reservoir (3), comprising: (a) selecting an underground rock formation (2) comprising an oil-bearing reservoir (3); (b) positioning two or more electrically conductive elements (4,5) at two or more spaced apart locations in proximity to said formation (2,3), at least one of said conductive elements (4,5) being disposed in or adjacent to a borehole affording fluid communication between the interior of said borehole and said formation; (c) imposing a controlled electrical charging potential between said two or more electrically conductive elements (4,5) for a charging time sufficient to cause a capacitive charging of said formation to an operating charging potential; (d) lowering or maintaining said charging potential below 40 mV per running meter between said two or more electrically conductive elements (4,5); and (e) withdrawing oil from at least one of said boreholes.

Further, there is disclosed herein a method of electrically enhancing oil recovery from an underground oil-bearing reservoir (3), comprising: (a) selecting an underground rock formation (2) comprising an oil-bearing reservoir (3); (b) positioning two or more electrically conductive elements (4,5) at two or more spaced apart locations in proximity to said formation (2,3), at least one of said conductive elements (4,5) being disposed in or adjacent to a borehole affording fluid communication between the interior of said borehole and said formation; (c) passing a controlled amount of electric current along an electrically conductive path through said formation, said electric current being produced by a DC source capacitor charging pump (1); (d) causing a capacitive charging of said formation at a charging potential; (e)

lowering or maintaining said charging potential below 40 mV per running meter between said two or more electrically conductive elements (4,5); and (f) withdrawing oil from at least one of said boreholes.

In one embodiment, the methods of electrically enhanced oil-production of the present invention are also methods of increasing the oil discharge pressure in a borehole in fluid connection with an underground oil-bearing reservoir (3).

Preferred said underground rock formation (2) or said underground oil-bearing reservoir (3) is a carbonate reservoir, preferably limestone, a siliceous reservoir, preferably sandstone, oil sand, or oil shale.

In measurements it has been established that the methods of electrically enhanced oil-production of the present invention are also methods of increasing the oil-gravity value (° API) of an oil-product obtained from an underground oil-bearing reservoir (3), in particular permanently increasing the oil-gravity value. Hence, the methods of the present invention are also methods of converting heavy oil into light oil prior to pumping said oil from said oil-bearing reservoir (3). Further, the methods of the present invention are also methods of reducing an oil-product viscosity prior to pumping said oil from said oil-bearing reservoir (3).

In measurements it has been established that the methods of electrically enhanced oil-production of the present invention are also methods of reducing the amount of inorganic contents in an oil-product obtained from an underground oil-bearing reservoir (3), in particular the water content or water cut.

In order to impose a controlled electrical charging potential between said two or more electrically conductive elements (4,5); the present inventors have developed a capacitor charging pump (1) having feedback means for providing a capacitive charging of an oil-bearing underground rock reservoir (3); which capacitor charging pump (1) having feedback means is adapted to provide and maintain a charging current either in the form of a direct current (DC), a direct current overlaid with an AC current, or as an alternating current (AC), between two or more electrically conductive elements (4,5) positioned at two or more spaced apart locations in proximity to said reservoir (3), at least one of said conductive elements being disposed in or adjacent to a borehole affording fluid communication between the interior of said borehole and said reservoir.

In one embodiment the capacitor charging pump (1) transforms a 3-phase AC-source into a galvanic separated direct current DC-source. In a preferred embodiment the DC-source is overlaid with an AC-signal. The DC-source can be controlled stepwise or continuously using a transformer and rectifier, thyristor or like components for creating a DC-source as known to the skilled person.

In the prior art, current is supplied to the electrodes usually as direct current between anode and cathode, and no particular interest is taken in preventing an over-charging of the underground rock between the electrodes. Rather a continuous pumping of energy into the electrodes to achieve increases in production rates and volumes has been at the center of attention until now. However, by using feedback means in the capacitor charging pump (1) of the present invention it is possible to keep the energy input necessary to maintain EEOP production once initiated to a minimum.

Under normal operation as known from the prior art, a direct current signal will be visible in an oscilloscope as a continuous wave-form during oil-production. Following the method of the present invention, the current signal during oil-production will be in the form of pulsed current sequences when viewed in an oscilloscope. Hence a feedback mechanism can easily be constructed by the skilled person based on this knowledge as the feedback mechanism must function to maintain a pulsed current when operating within the electric potential and power limits as given for the present method. The current signals of the invention can be measured inside the capacitor charging pump (1) or at measurement points between capacitor charging pump and the two or more electrodes.

In a preferred embodiment, the feedback means of the present invention comprises a controller adapted for executing a method of electrically enhanced oil-production according to the present invention. The controller of the invention can be a CPU or another controller comprising software adapted for executing a method of electrically enhanced oil-production according to the present invention.

An advantage of the feedback means is the possibility to cause a fast charging of the rock formation, e.g. at the prior art charging potentials above 0.4 V per running meter between electrodes, which can be lowered after charging has occurred to an operating charging potential of the present invention below 40 mV per running meter between electrodes. Doing so can lower the time needed for charging the rock formation between electrodes, but the necessary charging will still occur even at the operating charging potentials of the present invention without significantly influencing the charging time.

It is contemplated to use an operating charging potential which is a decade smaller than the lowest operating potentials previously contemplated in the prior art. The skilled person will know, based on the disclosures herein, that also operating charging potentials which are smaller by less than a decade compared to the prior art will yield increased oil production when following the present method. However, as the energy dissipated in the rock formation scales with the square to the electric potential, a ten times reduction in charging potential corresponds to about a hundred times reduction in dissipated energy.

The operating charging potential can be considered the minimum charging potential, which will cause an increase in oil production through the capacitive effect described herein. It depends primarily on physical parameters of the rock formation and the content of water and oil in the oil baring strata. The actual size of the operating charging potential is not significant for the present invention. Of interest is only, that once the rock formation has been charged, the charging potential can be lowered to or maintained at a potential of below 40 mV per running meter in order to compensate for the energy lost due to the EEOP process.

During operation said charging potential shall be lowered to or maintained at a value below 40 mV per running meter between said two or more electrically conductive elements once the operating charging potential has been reached. Preferably the charging potential during operation is from 5 to 40 mV per running meter between electrodes and the energy supplied is between 0.5 to 2.5 kWh or wherein the charging potential during operation is from 5 to 40 mV per running meter between said two or more spaced apart locations and/or the energy supplied is between 0.5 to 2.5 kWh.

In the most preferred embodiment said two or more spaced apart locations are all boreholes and said two or more electrically conductive elements (4,5) are all located in and/or in close proximity to said oil bearing underground rock reservoir (3) within said boreholes. In this manner only the actual oil bearing underground rock reservoir (3) is electrically stimulated according to the method which has the lowest energy requirement during production. However, this is not always feasible, and sometimes electrically conductive elements on the surface are employed in combination with electrically conductive elements located in the boreholes.

In an embodiment of the methods according to the invention said two or more electrodes (4,5) are arranged for maximum effect in anode-cathode pairs or in field arrays of anodes and cathodes such the electric fields of the anodes and cathodes are additive.

In an embodiment of the methods according to the invention said two or more electrodes (4,5) are made from a corrosive resistant and highly conductive material, preferably copper, titanium, graphite, and/or stainless steel.

Although the present invention has been described in detail for purpose of illustration, it is understood that such detail is solely for that purpose, and variations can be made therein by those skilled in the art without departing from the scope of the invention.

Field Test

An oil field located in Indonesia, the field being classified as mature/old, was selected for field tests.

Using an alternating current (AC) power source an electric field was created between a set of electrodes positioned in separate boreholes within said oil field located in Indonesia classified as mature/old. The oil field specifications are listed in Table 1:

TABLE 1

Oil Field Specifications

| Lithology | Sandstone |
|---|---|
| Porosity (%) | 13-24 |
| Permeability (mD) | 10-3,200 |
| Reservoir Temperature (° C.) | 70 |
| Reservoir Pressure (psi) | 100-600 |
| Oil Gravity (°API) | 30-33 |
| Oil Viscosity (cP) | 10-15 |
| Pour Point (° C.) | 31 |
| Water Salinity (ppm) | 8,000-10,000 |

Well pairs for anode and cathode were chosen according to the following criteria: (i) Same layer. (ii) Have casing or tubing that penetrate down to EEOP zone in earth. (iii) Maximum distance between well pairs of 500 m. (iv) Still having a remaining oil reserve. (v) Production line/test availability.

Two test cases were studied: Case 1—Low oil influx well, distance between electrodes 182 m. Case 2—High oil influx well, distance between electrodes 213 m.

Measurement preparation: (I) A part of the production line was replaced with plastic/rubber hose for electric insulation. (II) The flow line was disconnected from the anode well. (III) A gauge tank was installed in the production line as well as an individual test tank for measurement. (IV) Prior to EEOP the well was put on production until a stable oil rate was detected, which served as a production base line. (V) The power supply (3 phases, 380-480 V, 50 Hz) was connected to the respective electrode pairs and tested for connectivity. Energy input 0.5-2.5 kWh at 5-40 mV per running meter between electrodes. (VI) Directed charging and maintenance of the rock capacity was done using a capacitor charging pump (1) as developed by the present inventors. (VII) Oil production rate was tested every 24 hours.

Case 1—Low Oil Influx Well:

Baseline: Oil recovery below 1 BOPD, Fluid Column above Pump (FAP) 65 feet, water cut (WC) at 85%, API at 31.

EEOP: Initial oil recovery 3-4 BOPD at WC of 5% and API at 15. After two months of well operation using EEOP, a well cleanup was performed. After well cleanup EEOP at 10 BOPD at FAP of 300 ft. with API at 40. After end of EEOP, API dropped linearly with time from 40 back to starting point of 31 in the cause of 2 months.

Case 2—High oil influx well:

Baseline: Oil recovery at 6.5 BOPD, Fluid Column above Pump (FAP) 200 feet, water cut (WC) at 90%, API at 31.

EEOP: Initial oil recovery 15-20 BOPD at WC of 80-85% and API at 36-41. After two months of well operation using EEOP, a well cleanup was performed. After well cleanup EEOP at 60 BOPD at FAP of 300 ft. with API at 41. After end of EEOP, API dropped linearly with time from 41 back to starting point of 31 in the cause of 3 months.

Secondary oil recovery using heating was attempted in a baseline experiment but yielded lower production value than obtained using EEOP. Tertiary oil recovery using xylene and/or diesel flushing in the well cleanup procedure led to synergistic production effects together with EEOP. Surprisingly, the results of the present method are obtainable without the aid of additionally pumped water into the boreholes, without the aid of additional heating of the reservoir and/or without the aid of additional recovery enhancing chemicals such as emulsifiers or surfactants. Nevertheless, the methods of the invention, while beneficial without these further recovery methods, do not exclude their use.

Measurements performed on the oil-products before and after EEOP showed a reduced content of inorganic components, including sulfur, nitrogen, phosphorus, and/or water, in the light oils obtained with the EEOP method of the present invention compared to the heavy oils obtained from the wells prior to EEOP.

The linear decline in API after EEOP showed that a capacitive charging of the earth between electrodes had occurred, which released its energy slowly over time after termination of EEOP. Measurements of the chemical composition of the raw oil before and after EEOP showed that the increase in API is the result of a partial and permanent breakdown of longer chained oil molecules to smaller constituents, which are more easily transported within the rock formation. It is a very welcome additional benefit of the method of the present invention that the API-value is increased during operation (and consequently the viscosity is lowered) since this increases the selling value of the oil-product resulting from the method. In general high API-value oil-products receive a better market price due to lower energy consumption during refining and cracking.

Advantageous was further the increase in oil pressure as measured in FAP and the reduced water cut caused by the EEOP, factors which both serve to limit energy consumption during production and increase the selling value of the oil-product resulting from the method.

Closing Comments

The term "comprising" as used in the claims does not exclude other elements or steps. The term "a" or "an" as used in the claims does not exclude a plurality. A single processor or other unit may fulfill the functions of several means recited in the claims.

The invention claimed is:

1. A method for electrically enhancing oil-recovery from an underground oil-bearing reservoir (3), comprising:

a. selecting an underground rock formation (2) comprising an oil-bearing reservoir (3) into which at least two boreholes have been drilled for establishing fluid communication between an interior of a borehole and said formation (2);

b. positioning two or more electrically conductive elements (4,5) at two or more spaced apart locations in proximity to said formation (2,3), at least one of said conductive elements (4,5) being disposed in or adjacent to a said borehole affording fluid communication between the interior of said borehole and said formation (2), at least one conductive element serving as an anode (4) and at least one conductive element serving as cathode (5);

c. causing a capacitive charging of said formation (2) either by:

i. imposing a controlled electrical charging potential between said two or more electrically conductive elements (4,5) for a charging time sufficient to cause said capacitive charging of said formation to an operating charging potential;

or ii. passing a controlled amount of electric current along an electrically conductive path through said formation, said electric current being produced by a DC source (1), at a charging potential;

wherein:

capacitive charging of said oil-bearing underground rock reservoir (3) is done using a capacitor charging pump (1) having feedback means for providing a capacitive charging; which capacitor charging pump (1) having feedback means is adapted to provide and maintain a charging current either in the form of a direct current (DC), a direct current overlaid with an AC current, or as an alternating current (AC), between said two or more electrically conductive elements (4,5) positioned at two or more spaced apart locations in proximity to said reservoir (3); and wherein said method further comprises:

d. lowering or maintaining said charging or operating charging potential below 40 mV per running meter between said two or more electrically conductive elements (4,5); and e. withdrawing oil from at least one of said boreholes.

2. A method according to claim 1, wherein said method is a method for increasing an oil discharge pressure in said borehole in fluid connection with said underground oil-bearing reservoir (3).

3. A method according to claim 1, wherein said method is a method for increasing an oil-gravity value (° API) of an oil-product obtained from said underground oil-bearing reservoir (3).

4. A method according to claim 3, wherein said method is a method for permanently increasing an oil-gravity value (° API) of an oil-product obtained from said underground oil-bearing reservoir (3).

5. A method according to claim 3, wherein said method is a method for converting heavy oil to light oil prior to withdrawing said oil from said oil-bearing reservoir (3).

6. A method according to claim 3, wherein said method is a method of reducing an oil-product viscosity prior to withdrawing said oil from said oil-bearing reservoir (3).

7. A method according to claim 1, wherein said method is a method for reducing inorganic contents in an oil-product obtained from said underground oil-bearing reservoir (3).

8. A method according to claim 7, wherein said method is a method of reducing a content of one or more of sulfur, nitrogen, phosphorus and/or water from an initial higher content in said oil-product to a resulting lower content in said oil-product.

9. A method according to claim 1, wherein said underground rock formation (2) or said underground oil-bearing reservoir (3) is selected from a carbonate reservoir, a siliceous reservoir, limestone, sandstone, oil sand, or oil shale.

10. A method according to claim 1, wherein the charging potential during oil-recovery is from 5 to 40 mV per running meter between said two or more spaced apart locations and/or an energy supplied is between 0.5 to 2.5 kWh.

11. A method according to claim 1, wherein said two or more spaced apart locations are all boreholes and said two or more electrically conductive elements (4,5) are all located in and/or in close proximity to said underground oil-bearing reservoir (3).

12. A method according to claim 1, wherein said two or more electrically conductive elements (4,5) are made from a corrosive resistant and highly conductive material, preferably copper, titanium, graphite and/or stainless steel.

13. A method according to claim 1, wherein said two or more electrically conductive elements (4,5) are arranged in anode-cathode pairs or in field arrays of anodes and cathodes, wherein electric fields of the anodes and cathodes are additive.

14. A capacitor charging pump (1) having feedback means for providing a capacitive charging of an underground oil-bearing reservoir (3) comprised in an underground rock formation (2) into which at least two boreholes have been drilled for establishing fluid communication between an interior of a borehole and said formation (2);

which capacitor charging pump (1) having feedback means is adapted to provide and maintain a charging current between two or more electrically conductive elements (4,5) positioned at two or more spaced apart locations in proximity to said reservoir (3), at least one of said conductive elements being disposed in or adjacent to a borehole affording fluid communication between an interior of said borehole and said reservoir (3), said charging current being either in the form of a direct current (DC), a direct current overlaid with an AC current, or as an alternating current (AC);

wherein said charging current is provided and maintained by imposing a controlled electrical charging potential between said two or more conductive elements (4,5) or by passing a controlled amount of effective current along an electrically conductive path through said underground rock formation (2); and said capacitor charging pump (1) further comprises a controller adapted for executing a method according to claim 1.

15. The capacitor charging pump (1) having feedback means according to claim 14, wherein the capacitor charging pump (1) transforms a 3-phase AC-source into a galvanic separated direct current DC-source.

16. The capacitor charging pump (1) having feedback means according to claim 15, wherein the DC-source is overlaid with an AC-signal.

17. The capacitor charging pump (1) having feedback means according to claim 15, wherein the DC-source can be controlled stepwise or continuously using a transformer and rectifier, or a thyristor.

* * * * *